US009554678B2

(12) United States Patent
Wilson

(10) Patent No.: US 9,554,678 B2
(45) Date of Patent: Jan. 31, 2017

(54) DUAL HINGED SHEET PRODUCT DISPENSER

(75) Inventor: Rodney Wilson, Wilmington, DE (US)

(73) Assignee: SCA HYGIENE PRODUCTS AB, Göteborg (SE)

( * ) Notice: Subject to any disclaimer, the term of this patent is extended or adjusted under 35 U.S.C. 154(b) by 134 days.

(21) Appl. No.: 14/376,041

(22) PCT Filed: Feb. 2, 2012

(86) PCT No.: PCT/EP2012/051762
§ 371 (c)(1),
(2), (4) Date: Jul. 31, 2014

(87) PCT Pub. No.: WO2013/113392
PCT Pub. Date: Aug. 8, 2013

(65) Prior Publication Data

US 2014/0374433 A1 Dec. 25, 2014

(51) Int. Cl.
*A47K 10/44* (2006.01)
*A47K 10/42* (2006.01)
*A47K 10/32* (2006.01)

(52) U.S. Cl.
CPC ..... *A47K 10/424* (2013.01); *A47K 2010/3233* (2013.01); *A47K 2010/428* (2013.01)

(58) Field of Classification Search
CPC ..... A47K 10/44; A47K 10/42; A47K 10/424; A47K 10/3233; A47K 10/425
(Continued)

(56) References Cited

U.S. PATENT DOCUMENTS 5,829,197 A * 11/1998 Oh ..... E05D 15/505 16/231
6,003,716 A * 12/1999 Allison ..... B60R 7/04 220/326

(Continued)

FOREIGN PATENT DOCUMENTS

CN 101231115 A 7/2008
CN 101932271 A 12/2010

(Continued)

OTHER PUBLICATIONS

Screen Shot of https://www.ahdictionary.com/word/search.html?=into, The American Heritage Dictionary, Fifth Edition 2015.*

(Continued)

*Primary Examiner* — Patrick Mackey
(74) *Attorney, Agent, or Firm* — Drinker Biddle & Reath LLP

(57) ABSTRACT

A dispenser including a rear housing member and a front housing member that are connected by way of a first hinge so that the front housing member is openable relative to the rear housing member in order to fill a space defined by the front housing member and the rear housing member with at least one stack of sheet products. The front housing member and the rear housing member also include components for forming a second hinge. The first hinge allows the front housing member to open from a first side of the rear housing member in a first rotational direction, and the second hinge, when formed, allows the front housing member to rotate in an opposite direction from an opposite side of the rear housing member.

18 Claims, 5 Drawing Sheets

(58) Field of Classification Search
USPC ..... 221/45, 33
See application file for complete search history.

(56) References Cited

U.S. PATENT DOCUMENTS

| | | | | |
|---|---|---|---|---|
| 6,241,118 | B1 | 6/2001 | Tramontina | |
| 6,969,647 | B2 * | 11/2005 | Devoe | H01G 4/005 438/244 |
| 7,178,292 | B2 * | 2/2007 | Yamada | E05D 15/502 16/229 |
| 7,552,981 | B1 | 6/2009 | Tuniewicz et al. | |
| 7,913,355 | B2 | 3/2011 | Choi | |
| 8,196,265 | B2 | 6/2012 | Neukoetter et al. | |
| 8,573,715 | B1 * | 11/2013 | Jackman | A47K 10/32 220/4.22 |
| 2011/0024414 | A1 | 2/2011 | Widmer | |
| 2011/0174834 | A1 | 7/2011 | Case et al. | |
| 2011/0259908 | A1 | 10/2011 | Case et al. | |

FOREIGN PATENT DOCUMENTS

| | | | |
|---|---|---|---|
| JP | H09235923 | A | 9/1997 |
| RU | 2049274 | | 11/1995 |
| RU | 2223419 | | 2/2004 |
| RU | 2009 141 992 | A | 5/2011 |
| WO | WO-97/11630 | A1 | 4/1997 |

OTHER PUBLICATIONS

English-language translation of a Russian Office Action dated Nov. 9, 2015 issued in corresponding Russian Patent Application No. 2014135213 (4 pages).

European Office Action dated Apr. 14, 2016 issued in corresponding European patent application No. 12 703 069.0 (6 pages).

Wausau Paper Towel & Tissue: "OptiSery Dispensers: Cover Change Procedure", Apr. 20, 2011 (Apr. 20, 2011), p. 1, XP054976459, Retrieved from the Internet: URL:https://www.youtube.com/watch? v=zM4VnHrY9nO&nohtml5=False [retrieved on Apr. 8, 2016].

English-language translation of a Chinese Office Action dated Feb. 22, 2016 issued in corresponding Chinese Patent Application No. 201280068809.7 (7 pages).

English-language translation of a Russian Office Action dated Mar. 21, 2016 issued in corresponding Russian Patent Application No. 2014135213 (5 pages).

* cited by examiner

DUAL HINGED SHEET PRODUCT DISPENSER

TECHNICAL FIELD

The present disclosure is concerned with a dispenser for sheet products such as napkins. The present disclosure is particularly concerned with a dispenser of the gravity feed variety that includes a housing having a rear wall and a front wall connected by first and second side walls to define an interior space providing a reservoir for a stack of sheet products. A dispensing opening is provided in a face plate of the dispenser that provides a bottom cover for the housing.

BACKGROUND

A gravity feed sheet product dispenser as broadly defined above is known from US 2011/0174834 A1. The front wall of the sheet product dispenser is joined to a side wall by way of a hinge. The hinge is provided in the form of a first plurality (five in the figures) of cylindrical members that are axially spaced and a second plurality of cylindrical members that are axially spaced and arranged so that the first and second plurality of cylindrical members interdigitate so that axial bores in each of the members align and receive therethrough a cylindrical shaft. The front wall or door is openable about this hinge to allow access to the interior space defined by the housing for reloading the dispenser with a new stack of sheet products.

The front door in the prior art restricts a positioning of the dispenser at the site of use because room must be provided for the opening of the door about the hinge.

It is desired to provide a dispenser that may be located at a site with greater freedom.

SUMMARY

In a first aspect, there is provided a dispenser including a housing defining an interior space for receipt of a stack of sheet products, wherein the housing includes a front housing member and a rear housing member, wherein the dispenser includes a dispensing opening through which sheet products are dispensable, wherein the dispenser includes components to form a first hinge mechanism on a first side of the housing and components to form a second hinge mechanism on a second side of the housing opposed to the first side of the housing so that when the front housing member is mounted to the rear housing member about the first hinge mechanism, the front housing member is openable in a first sense about the first hinge mechanism and so that when the front housing member is mounted to the rear housing member about the second hinge mechanism, the front housing member is openable in a second sense opposed to the first sense about the second hinge mechanism, wherein the front housing member is openable relative to the rear housing member to provide access to fill the interior space with one or more stacks of sheet products.

In use, the front housing member can be mounted to the rear housing member by components of the first hinge mechanism or the second hinge mechanism depending upon user preference at the site, including the room that is available for accommodating opening of the front housing member. The front housing member is mountable on either side of the dispenser and is openable in opposed senses depending upon which hinge mechanism is selected. In this way, greater flexibility is offered in the on-site location of the dispenser by the provision of a dispenser that can be configured to be opened in either of two senses for refilling the product reservoir. That is, if a wall at the preferred site for the dispenser gets in the way of opening the front housing member, the front housing member can be reconfigured so as to open in the opposite direction and from the opposite side of the housing to thereby avoid the otherwise impeding wall.

The front housing member may include a hinge mechanism component of a first kind on a first side of the front housing member and a hinge mechanism component of a first kind on a second side of the front housing member, wherein the second side is opposite to the first side. The rear housing member may include a hinge mechanism component of a second kind on a first side of the rear housing member and a hinge mechanism component of a second kind on a second side of the rear housing member. The front housing member may be mounted to the rear housing member so that the hinge component of the first type on the first side of the front housing member and the hinge component of the second type on first side of the rear housing member are formed into the first hinge mechanism, so that when the front housing member opens and closes about the first hinge mechanism, the hinge component of the first type on the second side of the front housing member and the hinge component of the second type on the second side of the rear housing member move relative to one another. The first hinge mechanism may be formed by the addition of a further hinge component such as a pivot member. The further hinge component is removable to disassemble the first hinge mechanism.

The first hinge mechanism is dissasemblable and the hinge component of the first type on the second side of the front housing member and the hinge component of the second type on the second side of the rear housing member may be assembled into the second hinge mechanism, so that when the front housing member is opened and closed, the hinge component of the first type on the first side of the front housing member moves relative to the hinge component of the second type on the first side of the rear housing member. The second hinge mechanism may be assembled by incorporating said further hinge component described above or another such further hinge component.

The components for forming the first hinge mechanism and the components for forming the second hinge mechanism may be disposed interiorly of the housing so that when the front housing member is in a closed position, the components for the first hinge mechanism and the second hinge mechanism are covered by the housing with respect to an outside of the dispenser. The front housing member may include a front wall and sidewalls to define an interior cavity. The rear housing member may include a rear wall and side walls to define an interior cavity. The sidewalls of the rear housing member mate with the sidewalls of the front housing member when the front housing member is in a closed position with respect to the rear housing member and the components for the first hinge mechanism and the second hinge mechanism are disposed interiorly of the housing so that the mating side walls cover the components of the first and second hinge mechanisms.

By the provision of the front and rear housing members having a depth to them, as provided by the projecting side walls, it is possible to hide the components for the first and second hinge mechanisms in the depth of the front and rear housing members. Generally, it is desirable to do so for aesthetic reasons. In the context of a dispenser having two opposed sets of hinge mechanism components (one forming an operational hinge mechanism, the other not forming a hinge mechanism), it is especially important that the hinge mechanism components can be concealed from the outside. This manner of concealing a hinge mechanism is an independent aspect with respect to the provision of first and second hinge mechanisms.

The components for forming the first hinge mechanism and the second hinge mechanism may include an attached part attached to one of the front housing member and the rear housing member and a projecting part that projects into the other of the front and the rear housing member when the front housing member is closed to the rear housing member, wherein the projecting part is connectable to the other of the front and rear housing part at a hinge axis. The front housing member defines an interior cavity forming part of the interior space and the rear housing member defines an interior cavity forming part of the interior space. The attached part and the projecting part are disposed interiorly of the front or rear housing member when the front housing member is closed with respect to the rear housing. This unique hinge mechanism allows concealment thereof. The hinge is disposed interiorly, yet projects into the other housing member, which allows the hinge connection to be made between the two housing members in a way that is position inside the housing.

The components of the first and second hinge mechanisms may include a part in the form of an L or C-shaped bracket, wherein one leg of the L or C shape is attached to one of the front or rear housing members and the other leg of the L or C shape is configured to be connected to the other of the front or rear housing member about a hinge axis. The bracket may be otherwise shaped so that one end of the bracket is attached to an interior of a side wall of the front housing member and the other end is connected to an interior of a side wall of the rear housing member at a hinge axis, wherein the bracket includes a bend between the two ends of the bracket that spans edges of the side walls. The use of an L or C-shaped bracket provides clearance when opening the front housing member relative to the rear housing member, which is particularly useful for embodiments in which there is a depth to the front and rear housing members.

The components of the first and second hinge mechanisms may include a first hinge component disposed on the front housing member and a second hinge component disposed on the rear housing member, wherein the first and second hinge components cooperate with one another when the front housing member is closed with respect to the rear housing member. When the front housing member is mounted to the rear housing member about the first hinge mechanism, the first and second components of the second hinge mechanism are movable from a cooperating position when the front housing member is closed relative to the rear housing member to a spaced apart position when the front housing member is opened relative to the rear housing member. When the front housing member is mounted to the rear housing member about the second hinge mechanism, the first and second components of the first hinge mechanism are movable from a cooperating position when the front housing member is closed relative to the rear housing member to a spaced apart position when the front housing member is opened relative to the rear housing member.

The dispenser may include at least one pivot member that is engageable with components of one of the first and the second hinge mechanisms to cooperate those components so that the front housing member is mounted to the rear housing member about the one of the first and second hinge mechanisms and the front housing member is openable relative to the rear housing member about the at least one pivot member, and wherein the at least one pivot member is removable to release the components of the one of the first hinge mechanism and the second hinge mechanism to allow those components to move relative to one another to allow the front housing member to open relative to the rear housing member when the front housing member is mounted to the rear housing member about the other of the first and second hinge mechanisms.

The use of such a pivot member for forming the first hinge mechanism and the second hinge mechanism and for releasing the components of those mechanisms offers a simply implemented selectable hinge dispenser.

The pivot member may include first and second spaced apart legs arranged so as to be able to deflect toward one another to allow the pivot member to pass through bores in the hinge mechanism components to form the hinge mechanism and which resiliently reform into a more spaced apart condition to block removal of the pivot member through the bores. The pivot member may include at least one ledge associated with the legs to block the pivot member from passing back through the bores.

The components of the first and second hinge mechanism may include a first component attached to the front housing member that includes a bore and a second component attached to the rear housing member that includes a bore, and the dispenser includes a pivot pin selectively receivable in the bores of the first and second components of the first hinge mechanism or the first and second components of the second hinge mechanism to cooperate those components to respectively form the first hinge mechanism or the second hinge mechanism, wherein the pivot pin is selectively removable from the bores of the first and second components of the first hinge mechanism or the first and second components of the second hinge mechanism to release those components to move relative to one another. It may be that the pin and bores are arranged so that the pin is slideable into and out of the bores to form and release the hinge mechanism. Thus, the hinge mechanism can be formed without rotation and without the use of a tool. The pin may simply be translated by hand into the bores.

The dispenser may include a first support surface and a second support surface on one of the front housing member and the rear housing member and a projecting member sandwiched between the first and second support surfaces in forming the first hinge mechanism and the second hinge mechanism. The first and second support surfaces may be provided in the form of rails as described below.

The components of the first hinge mechanism and the second hinge mechanism may include a first projecting member disposed on one of the front housing member or the rear housing member, and first and second rails disposed on the other of the front housing member and the rear housing member, wherein when the front housing member is in a closed position relative to the rear housing member, the projecting members of the first and second hinge mechanisms are fittingly disposed between respective first and second rails. The rails offer a guide and support mechanism for the hinge side and the free side of the front housing member, allowing smooth operation of the hinge and also supporting the weight of the front housing member when it is closed.

The rails and the projecting member may include respective bores that are able to receive a pivot pin to form the first or the second hinge mechanism, wherein when the pivot pin is disposed in the bores to form one of the first hinge mechanism and the second hinge mechanism, the projecting member of the other of the first and second hinge mechanisms is moveable between a position disposed between the first and second rails when the front housing member is closed relative to the rear housing member and a position spaced away from the first and second rails when the front housing member is open relative to the rear housing member.

The components on one of the front or rear housing member may include a mounting feature disposed on opposed sides of the housing member. A hinge bracket may be mounted on one of the mounting features to form the first or the second hinge mechanism. The hinge bracket may be removable and mountable to the other mounting feature to form the other of the first and second hinge mechanisms. The components on the other of the front or rear housing member may include a cooperating hinge part disposed on opposed sides of the housing member and the hinge bracket is connected by way of a pivot member to one of the cooperating members to form the first hinge mechanism. The hinge bracket may be removed and mounted to the opposed side on the one housing member and the hinge bracket may be connected to the cooperating hinge part on the other side of the other of the housing members by removing the pivot member and remounting it to the cooperating hinge part and the hinge bracket to form the second hinge mechanism. The cooperating hinge parts may be at least one guide rail.

The front housing member includes a front wall and sidewalls to define a cavity therein and/or the rear housing member includes a rear wall and sidewalls to define a cavity therein. Part of the projecting member and/or part of the first and second rails protrude away from the cavity relative to the side walls. In this way, the projecting member is guided by the rails, on the hinge side, throughout the opening and closing motion and, on the free side, the projecting member is guided during an initial stage of the opening motion and during a final stage of the closing motion.

The front or the rear housing member may include components of a latch mechanism for holding a closed configuration of the front housing member relative to the rear housing member and which is releasable to allow the front housing member to be opened relative to the rear housing member for filling the interior space with at least one stack of sheet products, wherein a first of the components are disposed on the first side of the housing and a second of the components are disposed on the second side of the housing. In this way, the latch mechanism can be positioned on the first side when the hinge mechanism is disposed on the second side and the latch mechanism can be disposed on the second side when the hinge mechanism is disposed on the first side. Accordingly, both the latch mechanism and the hinge mechanism may be selectively applied on an appropriate side of the housing.

The front housing member may include a first component of the latch mechanism on the first and second sides of the housing and the rear housing member may include a second component of the latch mechanism on the first and second sides of the housing. The first component may be a mating part for receipt of a latch member and the second component may be a latch member mount. The dispenser may include a latch member mountable to either of the latch member mounts to form the latch mechanism, so that a portion of the latch member is receivable in the mating part when the front housing member is closed to hold the front housing member in the closed position and so that the portion is moveable out of the mating part to allow the front housing member to be opened. The mating part may be an opening such as a slot. The opening may be a recess in or an opening through a side wall of the front or rear wall member. The latch mechanism may resiliently clip into the mating part upon closing of the front housing member to the rear housing member.

The dispenser may further include at least one support member projecting from one of the front and the rear housing members that engages with the other of the front and rear housing members when in the closed position to support at least part of the weight of the front housing member.

The support member serves an alignment function to allow the front housing member and the rear housing member to properly align also serves to take some of the weight off the hinge mechanism when the front housing member is being closed. The projecting form of the support member provides support not just in the closed position of the front housing member but also as the front housing member is being closed. The support member thus allows a less robust, perhaps simplified, form for the hinge mechanism to be used, thereby allowing the unique hinge mechanism to be implemented.

The at least one support member may be spaced out of engagement with the other of the front and rear housing member when the front housing member is in an open position relative to the rear housing member and wherein the at least one support member comes into engagement with the other of the front and rear housing members as the front housing member is moved into the closed position. The support member thus also provides a guiding function for the closing motion of the front housing member.

The dispenser may include at least one such support member positioned at a top end of the housing. This position of the support allows the support member to perform a top to bottom direction alignment function between the front and rear housing members.

The front housing member may include a top wall and sidewalls extending from a front wall to define a cavity therein, wherein the at least one such support member engages with an interior side of the top wall. This offers a simplified structure for implementing the support function as it utilised the wall structure in place for forming the front housing member.

The at least one support member includes a tapered surface for guiding the front housing member into position with respect to the rear housing member as the engaging part of the front housing member is being closed and moved along tapered surface.

The dispenser may be a gravity feed dispenser. In such a case, the dispensing opening is located at a bottom of the housing. The dispenser may include an at least partly curved chute for guiding the stack of napkins to the dispensing opening. The dispenser may include the stack of napkins. The dispenser may include a stand for positioning the dispenser on a counter top or the like such that the dispensing opening is located at a bottom of the housing.

Considering a line passing through a centre of each of the napkin in the stack and through a centre of the dispensing opening, such a line defines a top to bottom direction. A rotation axis of the first and second hinge mechanisms is directed along the bottom to top direction. Put another way, a rotation axis of the first and second hinge mechanism is directed along long sides of the housing. That is, the first and second sides of the housing are long sides of the housing.

BRIEF DESCRIPTION OF THE FIGURES

These and other aspects will now be described in more detail, with reference to the appended drawings showing embodiment(s) of the invention, in which.

DETAIL DESCRIPTION OF PREFERRED EMBODIMENTS

Figure 1:
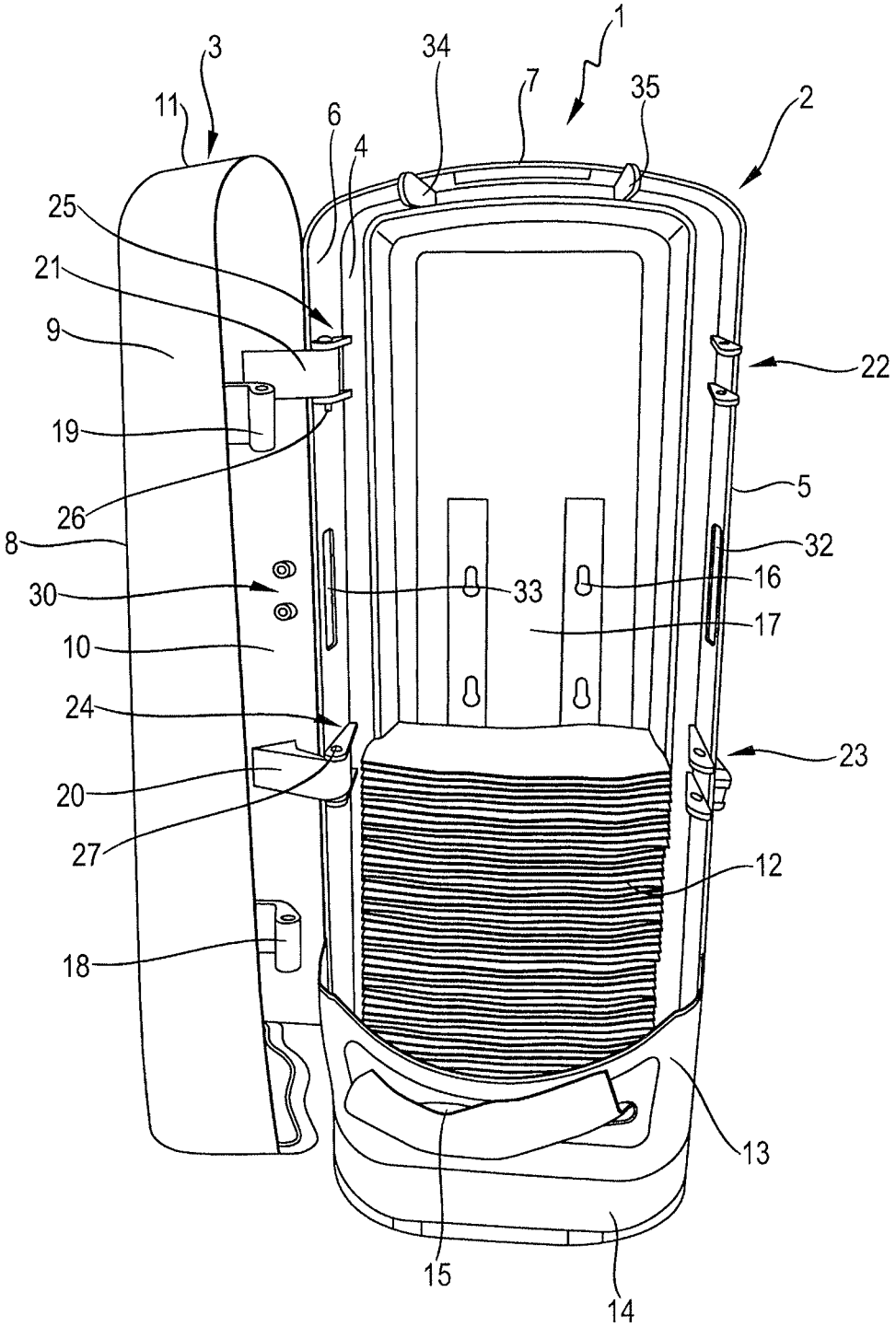
FIG. 1 shows a perspective view of a dispenser according to a first embodiment.

FIG. 1 shows a perspective view of a dispenser according to an embodiment. The dispenser includes a rear housing member and a front housing member that are connected by way of a first hinge mechanism so that the front housing member is openable relative to the rear housing member in order to fill a space defined by the front housing member and the rear housing member with at least one stack of sheet products. The front housing member and the rear housing member also include components for forming a second hinge mechanism. The first hinge mechanism allows the front housing member to open from a first side of the rear housing member in a first rotational sense, and the second hinge mechanism, when formed, allows the front housing member to rotate in an opposite sense from an opposite side of the rear housing member.

Figure 2:
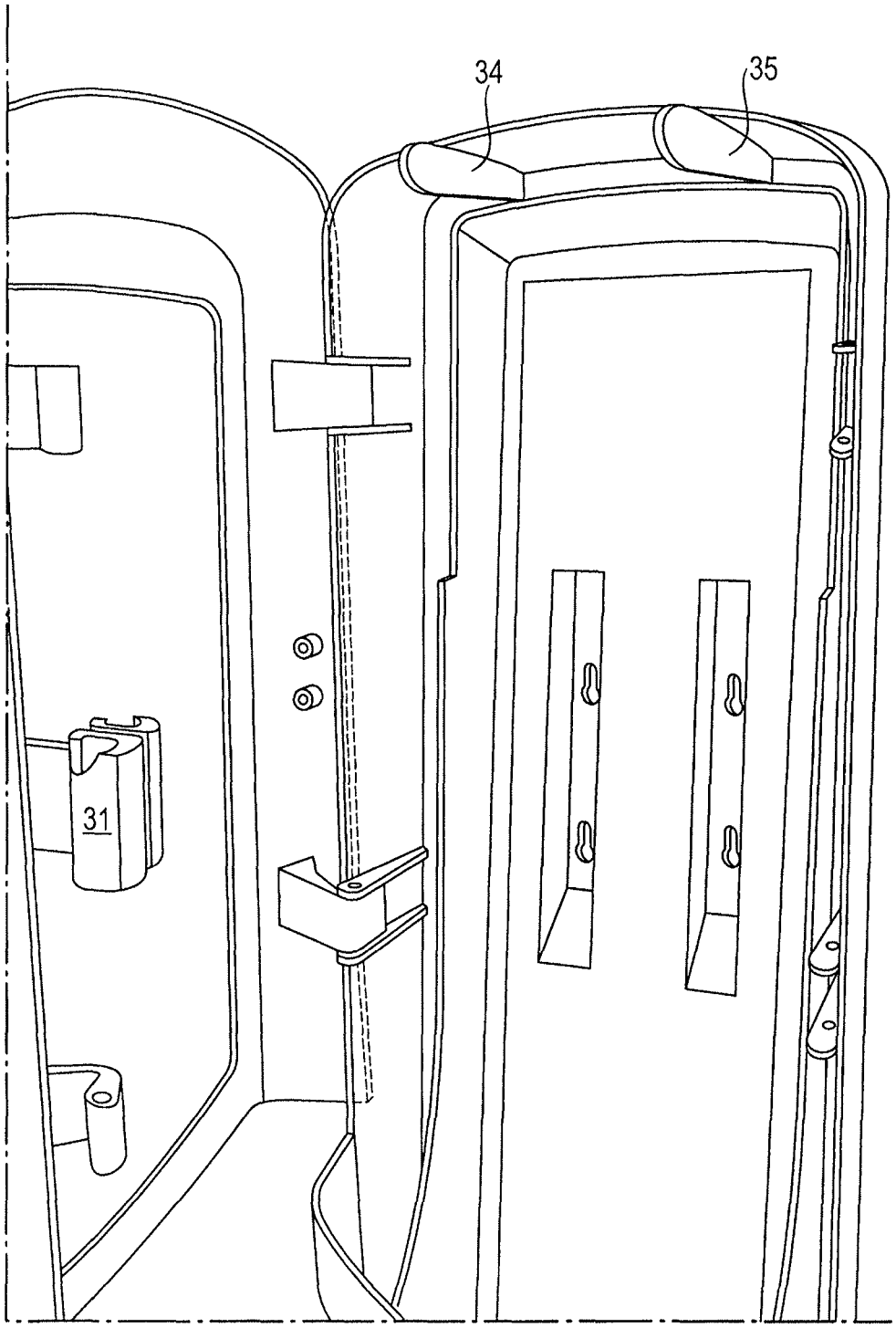
FIG. 2 shows another view of the dispenser of FIG. 1.

FIG. 2 shows another view of the dispenser of FIG. 1, in which a latch member can be seen mounted to an opposite side of the front housing member to the side of the front housing member including the first hinge mechanism. The latch member is engagable with an opening in the rear housing member in order to hold the front housing member in a closed position relative to the rear housing member. The front housing member includes first and second latch member mounts disposed on opposite sides of the front housing member so that the latch member can be mounted on either side of the front housing member depending upon whether the first hinge mechanism or the second hinge mechanism is operational, whereby the latch member is always mounted on an opposed side of the front housing member to the hinge mechanism formed between the front and rear housing members. The rear housing member includes latch openings on opposed sides so that the latch member has a counterpart component in the rear housing member irrespective of which side of the front housing member that the latch member is mounted.

Figure 3:
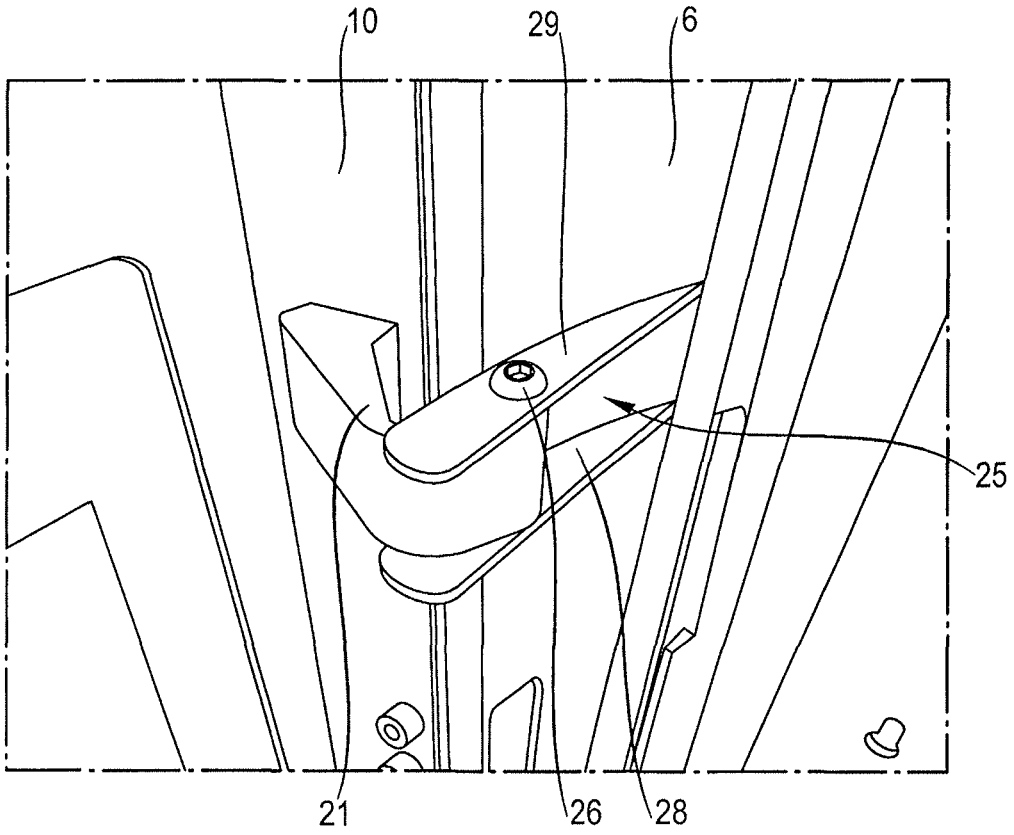
FIG. 3 shows a close up view of the hinge mechanism of the dispenser of FIG. 1.

FIG. 3 shows the particular form of the hinge mechanism in greater detail. A bracket is provided having one end attached to the front housing member and a free end with a bore therethrough. The free end of the bracket is disposed between rails attached to the rear housing member. A pivot pin extends through bores in the rails and the bore in the free end of the bracket to form the hinge mechanism. The front housing member rotates about a hinge axis passing longitudinally through the pivot pin. The bracket defines a bent shape so as to extend around a sidewall of the rear housing member so that the pivot pin and the free end are disposed inside the cavity defined by the rear housing member.

Figure 4:
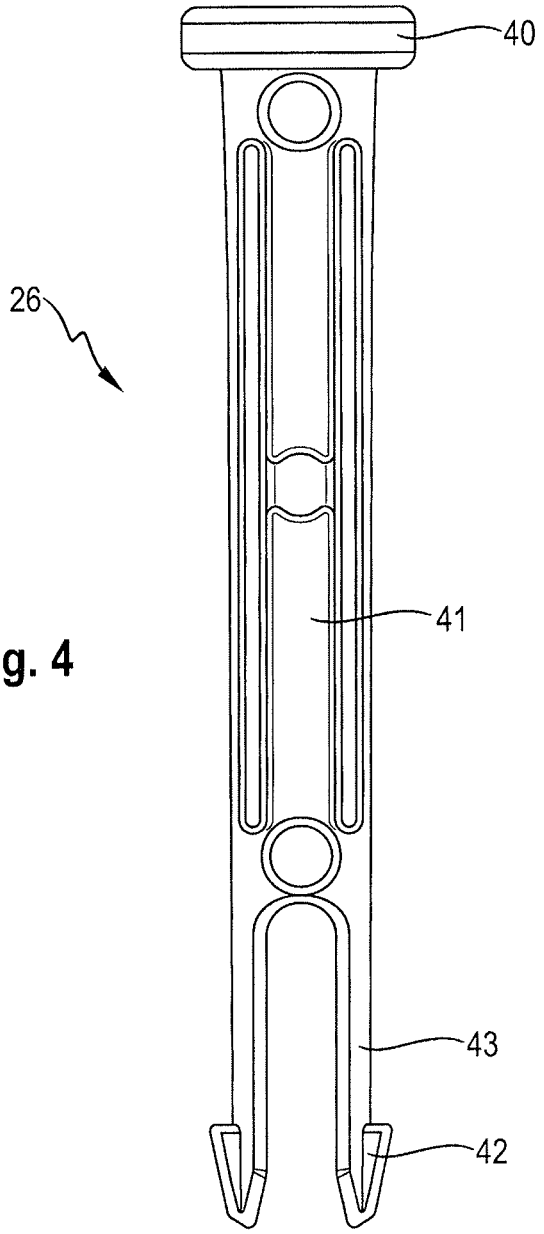
FIG. 4 shows a perspective view of an exemplary pivot pin forming the operative hinge mechanism of the dispenser of FIG. 1.

FIG. 4 shows a pivot pin for forming the operative hinge mechanism. The pivot pin includes a head that is too large to pass through bores in cooperating hinge parts and at least one ledge at a distal end that is unable to pass through the bores. The at least one ledge is disposed on deflectable legs to allow the ledge to move out of a blocking position to allow the pivot pin to be moved into or out of the bores.

Figure 5:
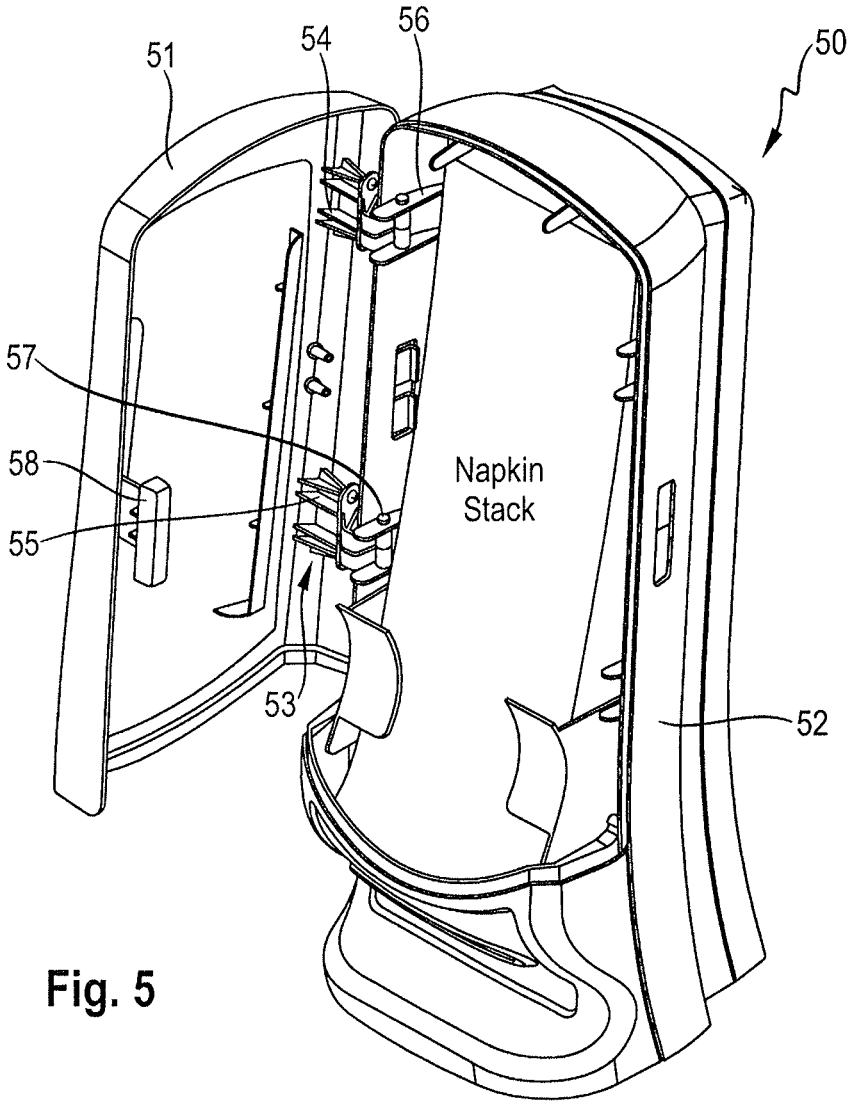
FIG. 5 shows a perspective view of a dispenser according to a second embodiment.

FIG. 5 shows an alternative embodiment of a dispenser in which hinge mounting features are disposed on opposite sides of a front housing member or door and the same hinge parts are used to form either a first hinge mechanism or a second hinge mechanism that open in opposite rotational senses by fastening the hinge parts to either the mounting features on one side of the door or the mounting features of the other side of the door. The rear housing member includes corresponding hinge mounting features on opposed sides thereof of the same kind as for the first embodiment of FIGS. 1 to 3.

Referring to FIG. 1, there is shown a dispenser 1 including a rear housing member 2 and a front housing member 3. The rear housing member 2 includes a rear wall 4 having sidewalls 5, 6 and a top wall 7 extending therefrom to define a cavity in the rear housing member 2. The front housing member 3 likewise includes a front wall 8, sidewalls 9, 10 and a top wall 11 that define a cavity in the front housing member 3. When the front housing member 3 is closed to the rear housing member 2, the cavities combine to define an interior space in which a stack of sheet products 12, e.g. napkins, is placed for dispensing from the dispenser 1. The rear housing member 2 includes a rear part and a bezel attached to the rear housing member. The front housing member 2 is attached to the bezel and forms a door for the dispenser 1 that is openable for stack loading purposes.

The dispenser 1 includes a face plate 13 including a stand portion 14 upon which the dispenser stands on a counter top or other work surface. The face plate 13 defines a dispensing opening 15 through which sheet products in the interior space defined by the housing 2, 3 are dispensed in a one-at-a-time fashion. The face plate 13 may be removable and replaceable with a different type of face plate in which the dispensing opening reveals edges of a plurality of napkins rather than a bottom surface of the lowermost napkin in the stack as with the implementation in FIG. 1. This alternative type of face plate could allow dispensing of a plurality of napkins at once. The alternative type of face plate may not include a stand portion 14. The dispenser 1 may be stood on its base or hung on an upright wall using the fastening holes 16 in the rear wall 4 of the rear housing member 2. In the standing or hanging configuration, the shown face plate 13 can be used or an alternative kind can be used, such as one allowing multiple dispensing of napkins at a time.

The rear housing member 2 contains a curved chute surface 17 so that the stack of napkins contained in the housing 2, 3 are guided into a more forward facing configuration towards the bottom of the interior space so that a bottom surface of a lowermost napkin in the stack is more forward facing for convenient access through the dispensing opening 15.

The front housing member 3 includes first, second, third and fourth hinge components 18, 19, 20 and 21 of a first hinge component type. The rear housing member 2 includes first, second, third and fourth hinge components 22, 23, 24 and 25 of a second hinge component type. The first and second hinge components 18, 19 of the first hinge component type are axially spaced on one side of the front housing member 3 and the third and fourth hinge components, 24, 25 of the first hinge component type are spaced along an opposite side of the front housing member 3. The hinge components 18, 19, 20 and 21 of the first type are positioned on the front housing member 3 at corresponding positions as the first to fourth hinge components 22, 23, 24 and 25 of the second type on the rear housing member 2 so that they cooperate with one another when the front housing member 3 is closed to the rear housing member 2. The cooperating hinge components of the first and second type are able to form a hinge mechanism disposed on one side of the housing 2, 3 or on the other side of the housing 2, 3 so that the front housing member 3 is able to be set up to open in opposite rotational directions.

In the embodiment of FIG. 1, the cooperating hinge components on the left side of the housing are connected by first and second pivot pins 26, 27 to form a first hinge mechanism on that side of the housing, while the cooperating hinge components of the first and second type on the right hand side of the housing are not connected by a pivot pin so that they are free to move into a cooperating position when the front housing member 3 is closed to the rear housing member 2 and into a spaced apart position when the front housing member 3 is in the shown open position.

Referring to FIG. 3, a formed hinge mechanism part can be seen in more detail. The hinge mechanism part includes the first hinge component 21 of the first type in the form of a bracket having a first end attached (e.g. integrally moulded, removably fastened or removably clipped in place) to an interior of the sidewall 10 and having a second end disposed between guide rails 28, 29 of the hinge component 25 of the second type. The guide rails 28, 29 and the second end of the bracket 21 include a bore extending through them for receipt of the pivot pin 26. The bracket 21 is bent so that the first end is attached interior of the front housing member 23 and the second end is connected by the pivot pin 26 interior of the second housing 22 with the bend being such that the bracket 21 does not contact an edge of the sidewall 6 of the rear housing member 2.

Continuing to refer to FIG. 3, the first and second guide rails 28, 29 protrude beyond an edge of the sidewall 6 of the rear housing member 2 and the second end of the bracket 21 protrudes beyond an edge of the sidewall 10 of the front housing member 3. The protrusion of the first and second guide rails 28, 29 supports and positions the bracket 21 during opening and closing of the front housing member 23. The protrusion of the bracket 21 allows the second end of the bracket 21 to be positioned interiorly of the rear housing member 2, which allows the front housing member 3 to open and close relative to the rear housing member 2 so that the edges of the sidewalls 4, 5 and the top walls 7, 8 of the front and rear housing members 2, 3 come into mating engagement when the front housing member 3 is closed while the opening and closing operation can be performed without the sidewalls 5, 6, 9, 10 obstructing each other during opening and closing of the front housing member 3.

The guide rails 28, 29 provide a support and guiding function not only for the functional hinge mechanism, but also for the cooperating hinge components that move relative to one another because they have not been formed into a functioning hinge mechanism by the introduction of a pivot pin.

The guide rails 28, 29 are, as can be seen in FIG. 3, configured so that the distal or free ends are splayed apart relative to one another. This is an optional feature of the embodiments. This serves to aid the guiding function and also aid a smooth operation of the hinge mechanism. One can imagine that just one of the guide rails 28, 29 could diverge relative to the other to achieve these functions, although perhaps not as effectively as both of the rails 28, 29 diverging.

Referring back to FIG. 1, a user is able to reconfigure the housing 2, 3, so that a hinge mechanism is formed on the other side of the housing 2, 3 to that shown. More specifically, the first and second pivot pins 26, 27 are removed from connecting the third and fourth hinge components 20, 21 of the first type to the third and fourth hinge components 24, 25 of the second type, to thereby free front housing member 3 from connection to the rear housing member 2. The cooperating hinge components on the other side of the housing, namely the first and second hinge components 18, 19 of the first type and the first and second hinge components 22, 23 of the second type are brought into position so that the first and second pivot pins 26, 27 can connect them. In this way, the front housing member 3 no longer rotates about a first side of the housing in a clockwise sense as in the arrangement shown in FIG. 1, but instead rotates from a second side of the housing in a counter-clockwise sense. This reconfiguration means that an obstructing wall can be avoided in the opening and closing operation of the front housing member 3 relative to the rear housing member 2 if necessary, and such is done by merely removing and repositioning the pivot pins 26, 27.

FIG. 4 shows a pivot pin 26 in more detail. The pivot pin 26 includes an enlarged head 40 relative to a shaft portion 41. At a distal end relative to the head 40 is first and second legs 43 that are spaced apart and able to be deflected together to narrow the space. The legs 43 resiliently reform to the spaced apart condition shown. The legs include ledges 42. The ledges 42 block removal of the pin 26 through the bores when the legs 43 are in the spaced apart condition and are thus required to be deflected toward one another in order to locate the pins 26, 27 in the bores or remove the pins 26, 27 to assemble or disassemble the hinge mechanism. The pins 26, 27 may be made of polymer materials and thus may be formed by injection moulding.

In use, when the front housing member 23 is closed relative to the rear housing member 2 about the first hinge mechanism formed by the hinge components 21, 25, 26 and the hinge components 20, 24 and 27, the hinge components 18, 19 of the first type enter the gap between the rails 28, 29 of the hinge components 22, 23 of the second type to guide the closing motion until the sidewalls 5, 9 are brought into mating contact.

Referring to FIG. 1, there can be seen a mounting component 30 in the form of fastening holes to which a latch member 31 is able to be attached. The latch member mounting component 30 is provided on an interior of the sidewall 10 on a first side of the housing 2, 3. A corresponding latch member mounting component (not shown) is provided on an interior of the sidewall 9 of the front housing member 3, which is an opposite side of the housing 2, 3. The latch member 31 can be mounted, using suitable fastening means such as screws to either of the opposed latch member mounting components 30 depending upon whether the hinge mechanism is set up on a first or a second side of the housing 2, 3. In the embodiment shown in FIG. 2, the latch member 31 is attached to a mounting component 30 provided on an opposite side of the housing 2, 3 to the functioning hinge mechanism.

The rear housing member 2 includes latch member mating parts 32, 33 in the form of openings through opposed sidewalls 5, 6 of the rear housing member 2. A bulbous end of the latch member 31 resiliently clips into the corresponding mating part 32, 33 when the front housing member is closed relative to the rear housing member 2 to maintain the closed portion. The bulbous end of the latch member 31 can be pushed back through the corresponding opening 32, 33 from outside of the dispenser 1, by the hand of a user in order to allow the front housing member 3 to be opened relative to the rear housing member 2.

To reconfigure the dispenser shown in FIG. 1 so that the front housing member 3 opens from the opposite side and in the opposite rotational sense to that shown in FIG. 1, the first and second pins 26, 27 are rearranged so that the functioning hinge mechanism is disposed on the opposite side of the housing 2, 3, as described above. Further, the latch member 31 shown in FIG. 2 is removed by undoing the fastening means and then the latch member 31 is moved to the opposite latch member mounting component 30 and the fastening means reinserted so that the latch member 31 is mounted on the opposite side to that shown in FIG. 2.

FIGS. 1 and 2 further show first and second support members 34, 35 attached to a top wall 7 of the rear housing member 2 and protruding outwardly from the edge of the top wall 7. The first and second support members 34, 35 have a tapered front edge and guide a top wall 11 of the front housing member 3 so that the edges of the top walls 7, 11 of the front and rear housing members 2, 3 are brought into mating contact. The first and second support members 34, 35 serve to guide and align the top walls 7, 11 of the rear and front housing members 2, 3 while they are being closed and also serve to take the weight of the front housing member 3 when the front housing member 3 is in the closed position with respect to the rear housing member 2 to help reduce the weight being carried by the hinge mechanism. The positioning of the free first and second hinge components 18, 19 of the first type between the guide rails 28, 29 of the first and second hinge components 22, 23 of the second type also serves to support the weight of the front housing member 23. Various alternatives to the specific embodiment shown in the figures can be envisaged. For example, instead of the provision of opposed hinge components of the first type, one can imagine that just first and second hinge components 20, 21 of the first type are provided and the front housing member 23 includes first, second, third and fourth mounting features, with the first and second mounting means disposed on one side of the housing and the third and fourth mounting means disposed on the other side of the housing. The first and second hinge components of the first type could be selectively mounted at the mounting means on either a first side of the housing or an opposite side of the housing by way of, for example, removable fasteners. Such an embodiment is described in greater detail with reference to FIG. 5, where only the differences to the preceding embodiment are discussed. The description given above is applicable to the embodiment of FIG. 5 for common features.

Referring to FIG. 5, the dispenser 50 has a door 51 mounted to a stack housing member 52 about a first hinge mechanism 53. The first hinge mechanism 53 includes first and second hinges each including a hinge bracket 54 as a removable piece that is mounted at one end (by way of removable fasteners) to a mounting feature 55 attached to the door 51 and is mounted at another end to guide rails 56 by way of a pivot pin 57. Although hidden in the figure, the door 51 includes corresponding mounting features 55 on both left and right sides of the door 51. The first hinge mechanism 53 may be disassembled by removing the pivot pins 57, and undoing fasteners holding the hinge brackets 54 to the mounting features 55. The bracket 54 may then be mounted to the mounting features 55 disposed on the opposite side of the door 51 by way of fasteners, such as screws, and connected to the guide rails 56 disposed on the opposite side of the stack housing 52 by way of the pivot pins 57, thereby allowing the door 51 to be mounted on either side of the stack housing 52 so as to open in either of opposed rotational directions. If present, the latch member 58 would also have to be mounted to the opposite side of the door 51 in the manner described above.

In the shown embodiment, there are two hinge parts on each side of the housing. One can imagine that embodiments of the present invention could also be implemented by the provision of one such hinge part or three or more such hinge parts.

The invention claimed is:

1. A dispenser, comprising:

a housing defining an interior space for receipt of a stack of sheet products, wherein the housing comprises a front housing member and a rear housing member;

a dispensing opening through which sheet products are dispensable;

components forming a first hinge on a first side of the housing; and components forming a second hinge on a second side of the housing opposed to the first side of the housing;

so that when the front housing member is mounted to the rear housing member about the first hinge, the front housing member is openable in a first rotational direction about the first hinge; and so that when the front housing member is mounted to the rear housing member about the second hinge, the front housing member is openable in a second rotational direction opposed to the first rotational direction about the second hinge;

wherein the front housing member is openable relative to the rear housing member to provide access to fill the interior space with one or more stacks of sheet products, and wherein components of the first hinge or the second hinge comprise a first component attached to the front housing member that comprises a bore and a second component attached to the rear housing member that comprises a bore, and the dispenser further comprises a pivot pin selectively receivable in the bores of the first and second components to cooperate those components, wherein the pivot pin is selectively removable from the bores of the first and second components to release those components to move relative to one another.

2. The dispenser of claim 1, wherein when the front housing member is in a closed position with respect to the rear housing member, the sidewalls of the rear housing member mate with the sidewalls of the front housing member and the components forming the first hinge and the components forming the second hinge are disposed interiorly of the housing, whereby the mating side walls cover the first and second hinge components with respect to an outside of the housing.

3. The dispenser of claim 1, wherein the first component of the first hinge or the second hinge comprises an attaching part attached to the front housing member and a projecting part that projects into the interior cavity of the rear housing member when the front housing member is closed with respect to the rear housing member, wherein the projecting part is connected to the second component of the first hinge or the second hinge at a hinge axis to thereby form the first hinge or the second hinge, and wherein the attached part and the projecting part of the first or second hinge are disposed interiorly of the side wall of the front and rear housing members when the front housing member is closed with respect to the rear housing member.

4. The dispenser of claim 1, wherein the first component of the first hinge or the second hinge comprises a part in the form of an L or C shaped bracket, wherein one leg of the L or C shape is attached to the front housing member and the other leg of the L or C shape is connected to the second component of the first hinge or the second hinge about a hinge axis.

5. The dispenser of claim 1, wherein when the front housing member is mounted to the rear housing member about the first hinge, the first and second components of the second hinge are movable from a position in close proximity to one another when the front housing member is closed relative to the rear housing member to a spaced apart position when the front housing member is opened relative to the rear housing member, and wherein when the front housing member is mounted to the rear housing member about the second hinge, the first and second components of the first hinge are movable from a position in close proximity to one another when the front housing member is closed relative to the rear housing member to a spaced apart position when the front housing member is opened relative to the rear housing member.

6. The dispenser of claim 1, wherein the first component or the second component of the first hinge or the second hinge comprises a hinge bracket disposed on one of the front housing member or the rear housing member and the other of the first component or the second component comprises first and second rails disposed on the other of the front housing member or the rear housing member that cooperate to form at least part of the first hinge or the second hinge.

7. The dispenser of claim 6, wherein the first and second rails are located on the first side of the housing and another set of first and second rails are located on the second side of the housing, wherein the bracket is selectively mountable between the first and second rails on the first and second sides of the housing by the pivot pin to respectively form at least part of the first or the second hinge.

8. The dispenser of claim 6, wherein the rails and the hinge bracket include the bores that are able to receive a pivot pin to form the first or the second hinge.

9. The dispenser of claim 6, wherein part of the hinge bracket of the first or second hinge and/or part of the first and second rails protrude away from the interior cavity of the front or rear housing member relative to the side walls.

10. The dispenser of claim 1, wherein the first component of the first hinge and the first component of the second hinge are disposed on opposed sides of the front housing member, wherein the rear housing member includes the second component of the first hinge and the second component of the second hinge are disposed on opposed sides of the rear housing member, wherein the first components on the front housing member align with the second components on the rear housing member when the front housing member is in a closed position relative to the rear housing member, and wherein the aligned components are respectively for forming one of the first or second hinges.

11. The dispenser of claim 1, wherein one of the front or the rear housing members include latch components for forming a latch for holding a closed configuration of the front housing member relative to the rear housing member and which is releasable to allow the front housing member to be opened relative to the rear housing member for filling the interior space with at least one stack of sheet products, the latch components arranged so that the latch is positionable on the first side of the housing or the second side of the housing.

12. The dispenser of claim 1, wherein the front housing member includes first latch components of a latch on the first and second sides of the housing and the rear housing member includes second latch components of the latch on the first and second sides of the housing, wherein the first latch components are one of a mating part for receipt of a latch member or a latch member mount and the second latch components are the other of a latch member mount or a mating part for receipt of a latch member, wherein the dispenser includes a latch member mountable to either of the latch member mounts to form the latch, so that the latch is positionable on the first side of the housing or the second side of the housing and so that a portion of the latch member is receivable in the mating part when the front housing member is closed to hold the front housing member in the closed position and so that the portion of the latch member is moveable out of the mating part to release the latch to allow the front housing member to be opened.

13. A dispenser, comprising:

a housing defining an interior space for receipt of a stack of sheet products, wherein the housing comprises a front housing member and a rear housing member;

a dispensing opening through which sheet products are dispensable;

a first hinge for mounting the front housing member to the rear housing member, wherein the front housing member is openable about the first hinge relative to the rear housing member to provide access to fill the interior space with one or more stacks of sheet products, wherein the front housing member includes a front wall and sidewalls to define an interior cavity, and the rear housing member includes a rear wall and side walls to define an interior cavity, wherein when the front housing member is in a closed position with respect to the rear housing member, the sidewalls of the rear housing member mate with the sidewalls of the front housing member and the first hinge is disposed interiorly of the housing, whereby the mating side walls cover the first hinge with respect to an outside of the housing, wherein a first component of the first hinge includes an attaching part attached to one of the front housing member or the rear housing member and a projecting part that comprises a bore and projects into the interior cavity of the other of the front housing member or the rear housing member when the front housing member is closed with respect to the rear housing member, wherein the projecting part is connected to the other of the front housing member or rear housing member at a hinge axis, and wherein the attaching part, the projecting part and the hinge axis of the first and the second hinges are disposed interiorly of the sidewalls of the front and rear housing members when the front housing member is closed with respect to the rear housing member, wherein a second component of the first hinge includes a bracket shaped so that one end of the bracket is attached at an interior of the other of the front housing member or the rear housing member from the one attached to the attaching part of the first component of the first hinge and the other end comprises a bore and is connected to the first component of the first hinge at a hinge axis, wherein the bracket includes a bend between the two ends of the bracket that spans edges of a side wall of the front housing member and a side wall of the rear housing member, and the dispenser further comprises a pivot pin selectively receivable in the bores of the first and second components to cooperate those components, wherein the pivot pin is selectively removable from the bores of the first and second components to release those components to move relative to one another.

14. The dispenser of claim 13, wherein the first component of the first hinge includes at least one first or second rail, and wherein the bracket of the first hinge is disposed to engage at least one of the first or second rail.

15. The dispenser of claim 14, wherein the first or second rail and the bracket include the bores that are able to receive the pivot pin to form the first hinge.

16. The dispenser of claim 14, wherein part of the bracket and/or part of the first and second rails protrude relative to the side walls in a direction away from the cavity.

17. The dispenser of claim 13, wherein the front and rear housing members further include components for forming a second hinge on the side of the housing opposite the first hinge, and wherein the first hinge is arranged to be able to be uncoupled so that the second hinge is able to be formed on an opposite side of the housing relative to the first hinge so that the front housing member is able to open from the opposed side of the housing about the second hinge in an opposite rotational direction as compared to the first hinge.

18. The dispenser of claim 13, wherein the pivot pin is removable by deflecting legs thereof to disarm a blocking surface that otherwise prevents removal of the pivot pin.

* * * * *